US009410102B2

(12) United States Patent
Eaton et al.

(10) Patent No.: US 9,410,102 B2
(45) **Date of Patent: *Aug. 9, 2016**

(54) GLYCEROL CONTAINING FUEL MIXTURE FOR DIRECT INJECTION ENGINES

(71) Applicant: SeaChange Group LLC, Brunswick, ME (US)

(72) Inventors: Scott Eaton, Hampden, ME (US); George Harakas, Blue Hill, ME (US)

(73) Assignee: SeaChange Group LLC, Brunswick, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/217,909

(22) Filed: Mar. 18, 2014

(65) Prior Publication Data

US 2014/0196358 A1 Jul. 17, 2014

Related U.S. Application Data

(63) Continuation of application No. 13/356,994, filed on Jan. 24, 2012, now Pat. No. 8,679,202.

(60) Provisional application No. 61/491,009, filed on May 27, 2011.

(51) Int. Cl.
*C10L 1/32* (2006.01)
*C10L 1/182* (2006.01)
(Continued)

(52) U.S. Cl.
CPC ..... *C10L 10/02* (2013.01); *C10L 1/026* (2013.01); *C10L 1/10* (2013.01); *C10L 1/1826* (2013.01);
(Continued)

(58) Field of Classification Search
CPC ..... C10L 10/02; C10L 1/10; C10L 1/328; C10L 1/1826; C10L 1/026; C10L 1/1852; C10L 1/231; C10L 2270/026; C10L 1/2286; C10L 1/1691; C10L 1/191; C10L 1/1885; C10L 1/1675; C10L 2200/029; C10L 2200/0446; C10L 1/19; C10L 1/1641; C10L 1/1811; C10L 1/1824; C10L 2200/0438; C10L 1/1985; C10L 1/125; C10L 2250/06; C10L 1/2381; C10L 1/238
USPC ..... 44/301, 302, 389, 436, 446, 447, 451; 123/1 A
See application file for complete search history.

(56) References Cited

U.S. PATENT DOCUMENTS 3,458,294 A 7/1969 Nixon
3,615,290 A * 10/1971 Nixon ..... 44/301
(Continued)

FOREIGN PATENT DOCUMENTS

EP 1 918 354 5/2008

OTHER PUBLICATIONS

Fernando et al., "Glycerol based automotive fuels from future biorefineries," Fuel, 86:2806-2809 (2007).
(Continued)

*Primary Examiner* — Pamela H Weiss
(74) *Attorney, Agent, or Firm* — Foley Hoag LLP

(57) ABSTRACT

The invention provides fuel mixtures containing fuel oil, glycerol, glycerol impurities and non-ionic surfactants. The mixtures remain homogeneous longer and are more chemically stable than previous mixtures. Upon combustion, the mixtures generate reduced SOx, NOx and particulate matter emissions compared to residual fuels and offer improved engine performance over previous mixtures.

28 Claims, 6 Drawing Sheets

(51) Int. Cl.

| | |
|---|---|
| ***C10L 1/197*** | (2006.01) |
| ***C10L 10/02*** | (2006.01) |
| ***C10L 1/02*** | (2006.01) |
| ***C10L 1/10*** | (2006.01) |
| *C10L 1/12* | (2006.01) |
| *C10L 1/16* | (2006.01) |
| *C10L 1/18* | (2006.01) |
| *C10L 1/185* | (2006.01) |
| *C10L 1/188* | (2006.01) |
| *C10L 1/19* | (2006.01) |
| *C10L 1/198* | (2006.01) |
| *C10L 1/228* | (2006.01) |
| *C10L 1/23* | (2006.01) |
| *C10L 1/238* | (2006.01) |

(52) U.S. Cl.

CPC ..... *C10L 1/328* (2013.01); *C10L 1/125* (2013.01); *C10L 1/1641* (2013.01); *C10L 1/1675* (2013.01); *C10L 1/1691* (2013.01); *C10L 1/1811* (2013.01); *C10L 1/1824* (2013.01); *C10L 1/1852* (2013.01); *C10L 1/1885* (2013.01); *C10L 1/19* (2013.01); *C10L 1/191* (2013.01); *C10L 1/1985* (2013.01); *C10L 1/2286* (2013.01); *C10L 1/231* (2013.01); *C10L 1/2381* (2013.01); *C10L 2200/029* (2013.01); *C10L 2200/0438* (2013.01); *C10L 2200/0446* (2013.01); *C10L 2250/06* (2013.01); *C10L 2270/026* (2013.01)

(56) References Cited

U.S. PATENT DOCUMENTS

| | | | | |
|---|---|---|---|---|
| 5,000,757 | A | 3/1991 | Puttock et al. | |
| 5,437,693 | A | 8/1995 | Iizuka et al. | |
| 6,113,661 | A | 9/2000 | Germanaud et al. | |
| 6,638,323 | B2 | 10/2003 | Tsai et al. | |
| 7,276,093 | B1 | 10/2007 | Rivas et al. | |
| 8,679,202 | B2 * | 3/2014 | Eaton et al. | 44/302 |
| 2001/0005955 | A1 * | 7/2001 | Langer et al. | 44/301 |
| 2005/0060928 | A1 | 3/2005 | Oldfield et al. | |
| 2007/0033862 | A1 | 2/2007 | Olliges | |
| 2008/0110083 | A1 | 5/2008 | Baehr et al. | |
| 2008/0153143 | A1 | 6/2008 | Schorken et al. | |
| 2010/0037513 | A1 | 2/2010 | Petrucci et al. | |

OTHER PUBLICATIONS

Striagas et al., "Processing of the glycerol fraction from biodiesel production plants to provide new fuels for heat generation," Energetika, T.54 Nr. 3, pp. 5-12 (2008).

International Search Report dated Jun. 2, 2013, from PCT/IB2012/002086.

Day et al., "(E)mission impossible,?" tce the chemical engineer, 839:33-35 (May 2011).

* cited by examiner

A

B

GLYCEROL CONTAINING FUEL MIXTURE FOR DIRECT INJECTION ENGINES

RELATED APPLICATIONS

This application is a continuation of U.S. patent application Ser. No. 13/356,994, filed Jan. 24, 2012, now U.S. Pat. No. 8,679,202, which claims the benefit of priority to U. S. Provisional Patent Application Ser. No. 61/491,009, filed May 27, 2011.

BACKGROUND OF THE INVENTION

1. Field of the Invention

The invention relates to viscous, low emission fuels, including those used to power marine engines.

2. Summary of the Related Art

Large ships, such as oil tankers, cruise ships and container vessels, have historically had slow-speed engines designed to bum cheap, highly viscous "bunker fuels"; the bottom of the barrel from the petroleum distillation process. This has been economically driven, because fuel costs are estimated to amount to 35-65% of the operating costs of these large ships. As these ships approach populated areas, the combustion of bunker fuels causes harmful levels of particulate matter, nitrogen oxides and sulfur dioxide emissions that can travel inland causing severe respiratory illnesses.

In 2010, the Marine Environment Protection Committee of the International Maritime Organization (IMO) adopted detailed and stringent emissions rules for these so-called Sulfur Emission Control Areas (SECAs). Presently, SECAs include most of the coastal areas of the United States, Canada and Europe and are likely to expand. Enforcement of these SECA standards as well as proposed IMO global emission limits on new engine builds are expected to reduce sulfur emissions by 98%, particulate matter by 85% and nitrogen oxides by 80%. New sulfur standards will phase in beginning in 2012, and will reach a limit of 1,000 parts per million by 2015. In addition, beginning in 2016, newly constructed ships will be required to demonstrate advanced emission control technology in accordance to the IMO regulations.

There is, however, an enormous existing international fleet of vessels having engines that are not readily compatible with burning less viscous, lower emission fuels. These ships are expected to have serviceable lifetimes extending many additional decades until newer, cleaner fleets gradually replace them.

Approaches to lowering emissions from these large ship engines are complex and accomplish only partial emissions reductions. For example, spraying water into the fuel/air mixture during combustion reduces NOx emissions, but does not address the SOx emissions and lowers peak engine load. Another example is fuel switching to cleaner, low-sulfur diesel fuels when transiting the SECAs. This approach greatly reduces particulate matter and SOx emissions, but requires the ships to carry multiple fuel sources and does not address NOx emissions. Further, this approach presents a danger of fire and explosion when these less viscous, lower flash point fuels are used in traditional marine engine types.

There is, therefore, a need for new cleaner burning fuels having suitable viscosity and flash points for these existing engines that, once burned, offer satisfactory emission profiles. One possibility is to mix viscous chemicals having inherent heat content with cleaner fuel oils. However, such chemicals tend to phase separate from the fuel oil, requiring mixing immediately before combustion, which is inconvenient and can be dangerous if done improperly. The present invention addresses these difficult problems.

BRIEF SUMMARY OF THE INVENTION

The invention relates to fuel mixtures containing glycerol. The invention provides fuel mixtures containing glycerol that are homogeneous or chemically stable for extended periods of time. The invention further provides processes for making such fuel mixtures, as well as fuel mixtures produced according to these processes.

The fuel mixtures according to the invention provide an important improvement over the related art because the fuel mixtures according to this invention are homogeneous or chemically stable for extended periods of time, and thus do not have to be produced immediately prior to combustion, unlike previous fuel mixtures containing glycerol.

In a first aspect, the invention provides a fuel mixture including a fuel oil selected from the group consisting of, but not limited to, marine gas oil, marine diesel oil, intermediate fuel oil, low sulfur diesel, ultra-low sulfur diesel and residual fuel oil; glycerol; and a non-ionic surfactant, wherein the mixture remains homogeneous at room temperature for at least 24 hours, and chemically stable for up to six months or more.

In a second aspect, the invention provides a fuel mixture produced by a process combining fuel oil, crude glycerol and a non-ionic surfactant, heating the crude glycerol to a temperature from about 40 to about 70° C., and mixing the fuel oil with crude glycerol utilizing an ultrasonic processor at from about 40 to about 75 Watts for from about 15 to about 40 seconds at about 20 kHz, with a total energy input of about 2,000 J per 150 mL, wherein the resultant mixture remains homogeneous for at least 24 hours, and chemically stable up to six months or more.

In a third aspect, the invention provides a process for producing a homogeneous fuel mixture comprising a fuel oil, crude glycerol and a non-ionic surfactant; heating the crude glycerol to a temperature from about 40 to about 70° C., and mixing the oil, crude glycerol and non-ionic surfactant with an ultrasonic processor at from about 40 to about 75 Watts for from about 15 to about 40 seconds at about 20 kHz, with a total energy input of about 2,000 J per 150 mL, wherein the resultant mixture remains homogeneous for at least 24 hours and chemically stable up to six months or more.

An object of the invention is to provide a fuel mixture that has viscosity, heat content and flash point properties that are suitable for use in existing marine engines, but which, upon combustion, produces lower emissions of sulfur dioxide ($SO_2$) and nitrous oxides (NOx) than conventional "bunker fuels" currently used to power marine engines.

DETAILED DESCRIPTION OF THE PREFERRED EMBODIMENTS

Figure 1:
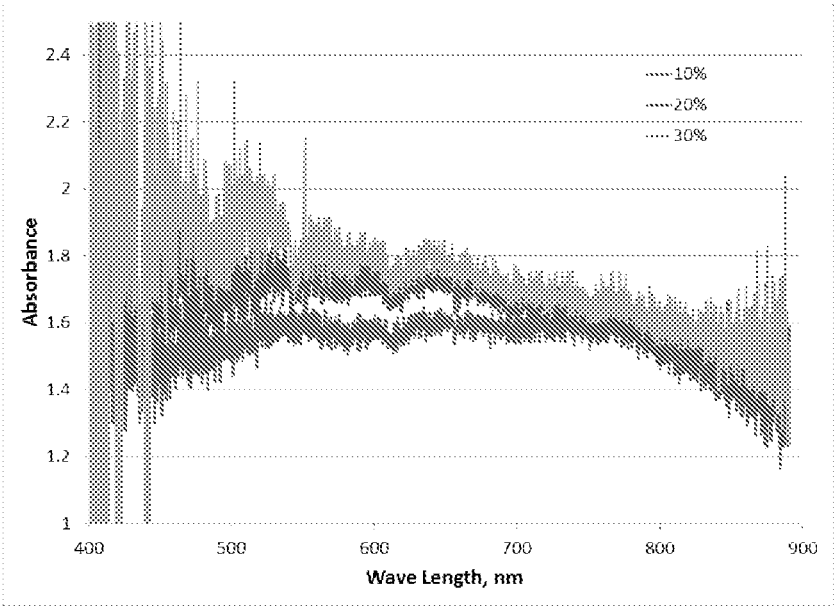
FIG. 1 shows a comparison of UV-VIS absorbance spectra for 10%, 20% and 30% glycerol in ultra-low sulfur diesel emulsions.

The invention relates to fuel mixtures containing glycerol. The invention provides fuel mixtures containing glycerol that are homogeneous or chemically stable for extended periods of time. The invention further provides processes for making such fuel mixtures, as well as fuel mixtures produced according to these processes.

The fuel mixtures according to the invention provide an important improvement over the related art because the fuel mixtures according to the invention are homogeneous or chemically stable for extended periods of time, and thus do not have to be produced immediately prior to combustion, unlike previous fuel mixtures containing a fuel oil and glycerol.

For purposes of the invention, the term "homogeneous" is intended to mean that the fuel mixture contains glycerol droplets of defined size that are evenly dispersed within the fuel oil, such that the fuel mixture has a physical appearance and physical properties that are characteristic of a homogeneous mixture. The physical properties of such a homogeneous mixture are further described below. The term "chemically stable" is intended to mean a fuel in which the fuel oil and glycerol may be phase separated, but in which the defined size of the glycerol droplets is maintained, such that the fuel mixture becomes homogeneous once again upon gentle mixing of the phases.

An object of the invention is to provide a fuel mixture that has viscosity, heat content and flash point properties that are suitable for use in existing marine engines, but which, upon combustion, produces lower emissions of sulfur dioxide ($SO^2$) and nitrous oxides (NOx) than conventional "bunker fuels" currently used to power marine engines.

In a first aspect, the invention provides a fuel mixture comprising a fuel oil selected from the group consisting of, but not limited to, marine gas oil, marine diesel oil, intermediate fuel oil, low sulfur diesel, ultra-low sulfur diesel and residual fuel oil; glycerol; and a non-ionic surfactant, wherein the mixture remains homogeneous or chemically stable at room temperature for at least 24 hours.

In some embodiments, the fuel oil is selected from low sulfur diesel and ultra-low sulfur diesel. In some embodiments, the mixture comprises from about 50% to about 99% oil (vol/vol). In some embodiments, the mixture comprises about 65% oil (vol/vol).

In some embodiments, the mixture comprises from about 1% to about 50% glycerol (vol/vol). In some embodiments, the mixture comprises about 35% glycerol (vol/vol). Most commercially available glycerol preparations contain certain contaminants, such as salts, methanol and water. It is preferred that these contaminants be present in the glycerol in such low quantities as to limit the total concentration of the contaminants in the fuel mixture to controlled levels. Thus, in some embodiments the glycerol contains less than about 5% salt (wt/wt). In some embodiments the glycerol contains about 1% salt (wt/wt). In some embodiments, the glycerol contains less than about 10% methanol (wt/wt). In some embodiments, the glycerol contains about 2-5% methanol (wt/wt). In some embodiments, the glycerol contains less than about 20% water (wt/wt). In some embodiments the glycerol contains about 1-5% water (wt/wt).

To improve the combustion properties of the glycerol, combustion improvers may be added to the glycerol. In some embodiments, the glycerol contains less than about 10% combustion improver (wt/wt). In some embodiments, the glycerol contains about 5-10% combustion improver (wt/wt). In some embodiments, the combustion improver is selected from ethers, peroxides, nitriles, and mixtures thereof.

The homogeneity or chemical stability of the fuel mixture is provided in part by controlling the size of the glycerol droplets. Controlling the size of the glycerol droplets is also useful to allow the glycerol droplets to pass through the fuel filters, which generally have a particle size cutoff of about 5-20 μm. In some embodiments, the glycerol has droplet sizes of from about 100 nm to about 10 μm. In some embodiments, the glycerol has droplet sizes of from about 1 μm to about 4 μm. Droplet size is readily measured by laser scattering at 633 nm wavelength.

The homogeneity or chemical stability of the fuel mixture can be further improved by the addition of one or more non-ionic surfactants to the fuel mixture. In some embodiments, the mixture comprises from about 0.1% to about 5% non-ionic surfactant (wt/wt). In some embodiments, the mixture comprises from about 0.1% to about 5% non-ionic surfactant (wt/wt). In some embodiments, the mixture comprises about 1% non-ionic surfactant (wt/wt). In some embodiments, the non-ionic surfactant is selected from, but not limited to, the group consisting of one or more of polyethylene glycol, polyoxyethylene, glycerides, polyglycerols, sorbitan glycosides, esters and acids, or mixtures thereof.

In some instances, the viscosity of the fuel mixture may be increased by adding viscosity enhancers to the fuel oil phase. Such viscosity enhancers include, without limitation, resins, resin acids, polyureas, nitroesters, polyolefins, elastomers, and mixtures thereof.

While not critical to the invention, it has been observed that in some embodiments of the fuel mixture, the mixture has a heating energy of from about 30 to about 44 kJoules per kilogram, typically about 38 kJoules per kilogram. Heating content can be measured using a bomb calorimeter.

As discussed above, it is an object of the invention to provide a fuel mixture that, when combusted, produces lower emissions of $SO^2$ and NOx than conventional bunker fuels used to power marine engines. In some embodiments, the mixture, when created, contains less than about 0.1% by mass elemental sulfur. Elemental sulfur in fuel oils can be measured by energy-dispersive x-ray fluorescence in the liquid phase. In some embodiments, the mixture, when combusted in a marine diesel engine, produces less than about 10 g/kwh NOx. NOx can be measured in the exhaust by standard procedures using a chemiluminescence analyzer.

These reduced emissions can be achieved by using in the fuel mixture a fuel oil that has lower sulfur and nitrogen content than conventional bunker fuels. However, such fuel oils generally have viscosities, specific gravities and flash points that are not suitable for commonly used marine diesel engines. The fuel mixture according to the invention overcomes these problems. In some embodiments, the mixture has a viscosity of from about 5 to about 200 cst at 40° C. In some embodiments, the mixture has a viscosity of from about 12 to about 20 cst at 40° C. Typically, viscosity is measured by standard procedures using an efflux cup. In some embodiments, the mixture has a specific gravity of from about 0.83 to about 1.2. In some embodiments, the mixture has a specific gravity of from about 0.9 to about 1.0. In some embodiments, the mixture has a flash point of from about 50° C. to about 160° C. In some embodiments, the mixture has a flash point of about 60° C.

Another complication in combusting heavy fuel residuals is the accumulation of carbon and ash deposits on exposed and mated surfaces within the engine due to low hydrogen saturation of the organic molecules. This situation is monitored through the heating of the fuel in an open flask and the residual content weighed and termed the ramsbottom carbon in accordance to ASTM-D524. In some embodiments, the mixture contains less than about 5% wt. ramsbottom carbon. In some embodiments, the mixture contains less than about 1% wt. rams bottom carbon. As discussed above, a significant advantage of the fuel mixture according to the invention is that it is homogeneous and remains homogeneous or chemically stable for extended periods of time, thereby obviating the need to produce the mixture immediately prior to combustion. In some embodiments, the mixture remains homogeneous or chemically stable at room temperature for at least 2 weeks. In some embodiments, the mixture remains homogeneous or chemically stable at room temperature for at least 3 months. In some embodiments, the mixture remains homogeneous or chemically stable at room temperature for at least 6 months.

In a second aspect, the invention provides a fuel mixture produced by a process comprising fuel oil, crude glycerol and a non-ionic surfactant, heating the crude glycerol to a temperature from about 40 to about 70° C., and mixing the oil, crude glycerol (commercial grade) with an ultrasonic processor at from about 40 to about 75 Watts for from about 15 to about 40 seconds at about 20 kHz, with a total energy input of about 2,000 J per 150 mL, wherein the resultant mixture remains homogeneous or chemically stable for at least 24 hours. In some embodiments, the crude glycerol is heated to about 50° C.

A variety of fuel oils may be used to produce the fuel mixture according to this aspect of the invention. In some embodiments, the fuel oil is selected from the group consisting of marine gas oil, marine diesel oil, intermediate fuel oil, low sulfur diesel, ultra-low sulfur diesel and residual fuel oil. In some embodiments, the fuel oil is selected from low sulfur diesel and ultra-low sulfur diesel. In some embodiments, the mixture comprises from about 50% to about 99% oil (vol/vol). In some embodiments, the mixture comprises about 65% oil (vol/vol). In some embodiments, a mixture of intermediate fuel oil and marine gas oil is used. In some embodiments, the ratio of intermediate fuel oil and marine gas oil is about 2.5:1 (vol/vol) and the combination comprises about 50% of the total fuel mixture.

As described above, the fuel oil is mixed with glycerol to produce the fuel mixture according to this aspect of the invention. The mixture comprises from about 1% to about 50% glycerol (vol/vol). In some embodiments, the mixture comprises about 35% (vol/vol) glycerol. In some embodiments, the glycerol contains less than about 5% salt (wt/wt). In some embodiments, the glycerol contains about 1% salt (wt/wt). In some embodiments, the glycerol contains less than about 10% methanol (wt/wt). In some embodiments, the glycerol contains about 2-5% methanol (wt/wt). In some embodiments, the glycerol contains less than about 20% water (wt/wt). In some embodiments, the glycerol contains about 5-10% water (wt/wt).

In some embodiments, a combustion improver is added to the glycerol prior to mixing the glycerol and the fuel oil. In some embodiments, the glycerol contains less than about 10% combustion improver (wt/wt). In some embodiments, the glycerol contains about 5-10% combustion improver (wt/wt). In some embodiments, the combustion improver is selected from the group consisting of one or more ether, peroxide, nitrile, and mixtures thereof. During mixing, the glycerol forms droplets. In some embodiments, the glycerol forms droplet sizes of from about 100 nm to about 10 μm. In some embodiments, the glycerol forms droplet sizes of from about 1 μm to about 4 μm.

As discussed above, one or more non-ionic surfactants are mixed with the fuel oil and the glycerol. In some embodiments, the mixture comprises from about 0.1% to about 5% non-ionic surfactant (wt/wt). In some embodiments, the mixture comprises from about 0.1% to about 5% non-ionic surfactant (wt/wt). In some embodiments, the mixture comprises about 1% non-ionic surfactant (wt/wt). In some embodiments, the non-ionic surfactant is selected from, but not limited to, the group consisting of one or more of polyethylene glycol, polyoxyethylene, glycerides, polyglycerols, sorbitan glycosides, esters and acids, or mixtures thereof.

In some embodiments, a viscosity enhancer is mixed with the fuel oil, glycerol and non-ionic surfactant. In some embodiments, the viscosity enhancer is selected from, without limitation, the group consisting of resins, resin acids, polyureas, nitroesters, polyolefins, elastomers, and mixtures thereof.

In some embodiments, the mixture has a heating energy of from about 30 to about 44 kJoules per kilogram. In some embodiments, the mixture has a heating energy of about 38 kJoules per kilogram. In some embodiments, the mixture, when created, contains less than about 0.1% by mass elemental sulfur. In some embodiments, the mixture, when combusted in a marine diesel engine, produces less than about 10 g/kWh NOx.

In some embodiments, the mixture has a viscosity of from about 5 to about 200 cst at 40° C. In some embodiments, the mixture has a viscosity of from about 12 to about 20 cst at 40° C. In some embodiments, the mixture has a specific gravity of from about 0.83 to about 1.2. In some embodiments, the mixture has a specific gravity of from about 0.9 to about 1.0. In some embodiments, the mixture has a flash point of from about 50° C. to about 160° C. In some embodiments, the mixture has a flash point of about 60° C.

In some embodiments, the mixture contains less than about 5% wt. ramsbottom carbon. In some embodiments, the mixture contains less than about 1% wt. ramsbottom carbon.

The mixture is mixed to homogeneity. In some embodiments, the mixture remains homogeneous or chemically stable at room temperature for at least 2 weeks. In some embodiments, the mixture remains homogeneous or chemically stable at room temperature for at least 3 months. In some embodiments, the mixture remains homogeneous or chemically stable at room temperature for at least 6 months.

In a third aspect, the invention provides a process for producing a homogeneous fuel mixture comprising fuel oil, crude glycerol (commercial grade) and a non-ionic surfactant, heating the crude glycerol to a temperature from about 40 to about 70° C., and mixing the oil, crude glycerol with an ultrasonic processor at from about 40 to about 75 Watts for from about 15 to about 40 seconds at about 20 kHz, with a total energy input of about 2,000 J per 150 mL, wherein the resultant mixture remains homogeneous or chemically stable for at least 24 hours. In some embodiments, the crude glycerol is heated to about 50° C.

The following examples are intended to illustrate certain embodiments of the invention and are not intended to limit the scope of the invention.

EXAMPLE 1

Demonstration of Achievable Droplet Sizing

Reagent Grade Glycerol Ultrasonically Blended with ULSD with a Mixture of Span80 and Tween80.

Figure 2:
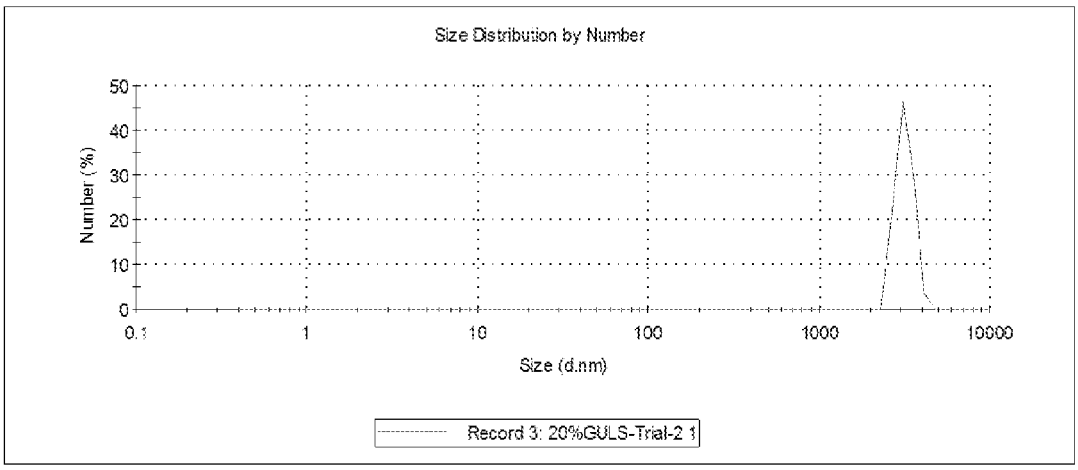
FIG. 2 shows (A) glycerol droplet size number distribution of the sample showing a 1-4 microns range; (B) statistically relevant glycerol droplet size number distribution showing that most droplets are 2 microns in diameter.
Figure 2:
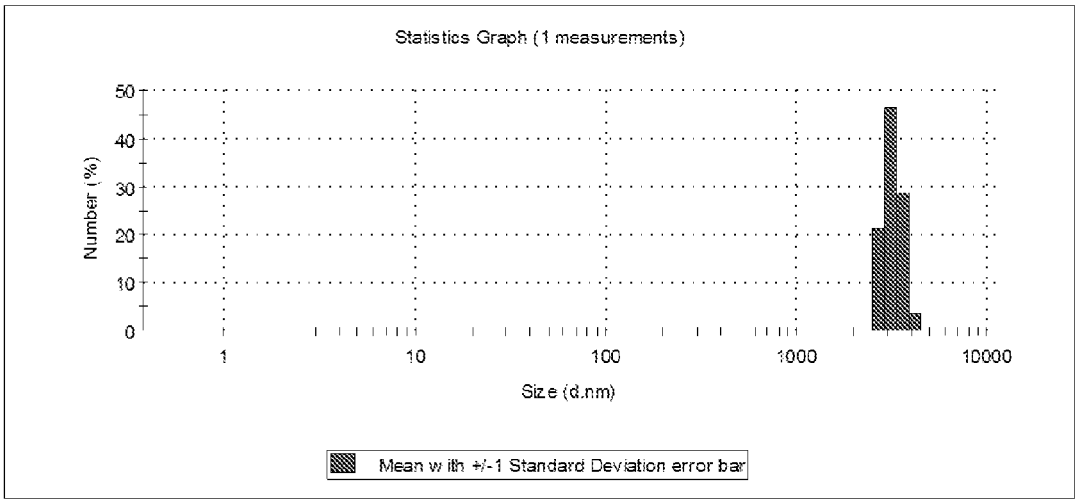

20 mL of reagent grade glycerol is placed in a 300 mL wide-mouth Pyrex beaker. 80 mL of ultra-low sulfur diesel, 15 ppm or less of sulfur, containing dissolved span 80 (2.4 g) and tween 80 (0.5 g) is then added. The mixture is placed in a water bath and brought to 50° C. The heated mixture is ultrasonically processed using a 20 kHz ultrasonic processor with a ½" horn operating with an intensity of 55 Watts for 20 seconds for a total of 1,143 Joules of energy input. The resulting mixture is allowed to slowly cool to 21° C. in a thermally controlled environment. Upon cooling the sample obtains a homogeneous amber color and a viscosity of 11 cst. The blended sample containing the 20 mL glycerol (20% total mixture volume) is analyzed using a UV-Vis spectrophotometer as well as a laser droplet sizer which utilizes light at a wavelength of 633 nm to calculate the droplet size distribution. The resulting UV-Vis spectrophotometer spectra is shown in FIG. 1 and compared to spectra obtained at 10% volume and 30% volume of glycerol in ULSD at the same surfactant weight ratio. The spectra for the 20% vol. glycerol sample show an absorbance at 633 nm of 1.71. This sample was subsequently analyzed by a laser droplet sizer that demonstrated a resulting droplet size distribution spanning 1-4 microns is shown in FIG. 2.

EXAMPLE 2

Figure 6:
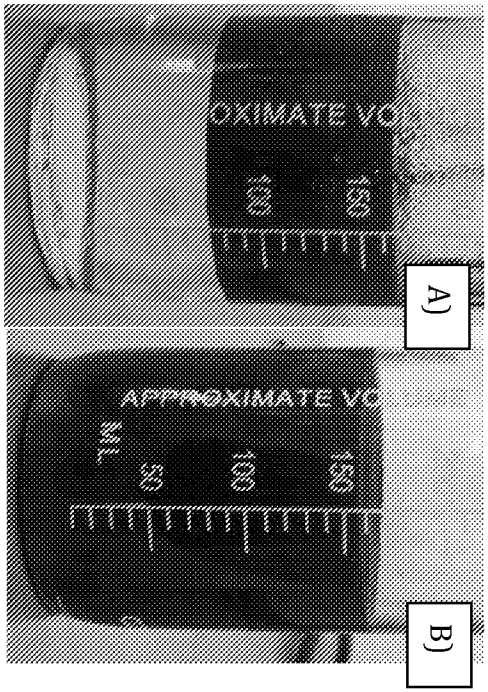
FIG. 6 shows the fuel mixture produced in example 2 in A) prior to fuel mixture processing and B) 168 hours after fuel processing

Demonstrated Emulsion Creation with Intermediate Fuel Oil 180, 99% Pure Glycerin, Marine Gas Oil, Span 80 and Span 85 Surfactants In this experiment, 70 mL of 99% pure glycerin was placed in a 300 mL wide mouth Pyrex® bottle. Added onto of the glycerin was 60 mL of intermediate fuel oil 180, 25 mL of marine gas oil, 3 mL of span 80 surfactant and 2 mL of span 85 surfactant for a total sample volume of 160 mL. The mixture was place in a water bath and heated to a uniform temperature of 70° C. The mixture was then vigorously agitated by hand to create a uniform appearing mixture. The mixture was immediately emulsified using an ultrasonic processor which utilized a ½" horn operated at a frequency of 20 kHz with a power output of 75 Watts for 20 seconds for a total power output of 1,523 Joules. The resulting emulsion was dark brown in color and uniform. The emulsion remained homogeneous in nature for over 168 hours at room temperature. This homogeneous mixture is shown in FIG. 6. In the A) free glycerol layer is clearly present at the bottom with heavy fuel oil 180 and surfactant on top. After processing B) the glcycerol emulsion remains homogeneous for extended periods of time.

EXAMPLE 3

Demonstrated 24+ Hour Emulsion Homogeneity Using Ultra-Low Sulfur Diesel, Reagent Glycerol, Water and Technical Grade Mono-/di-/tri-glycerides In this experiment, 100 mL of ultra-low sulfur diesel fuel, 15 ppm sulfur concentration, was placed in a 300 mL wide mouth Pyrex bottle along with 25 mL glycerol and 25 mL water. A surfactant consisting of a technical grade blend of mono-/di- and tri-glycerides was splashed into the mixture with a total volume of 4 mL. The entire contents were heated to 50° C. in a water bath. The sample was ultrasonically processed for 20 seconds using an ultrasonic processor operating at 20 kHz with a ½" horn. The sonic power output was 50 Watts for a total of 1,077 J of energy applied to the fuel mixture. The final appearance of the emulsion is a homogeneous milky white viscous liquid with a viscosity of 9 cst. at 25° C. The sample was transferred to a 250 mL glass bottle and placed in a 25 ° C. water bath for observation. The sample remained homogeneous for over 24 hours at room temperature.

EXAMPLE 4

Figure 3:
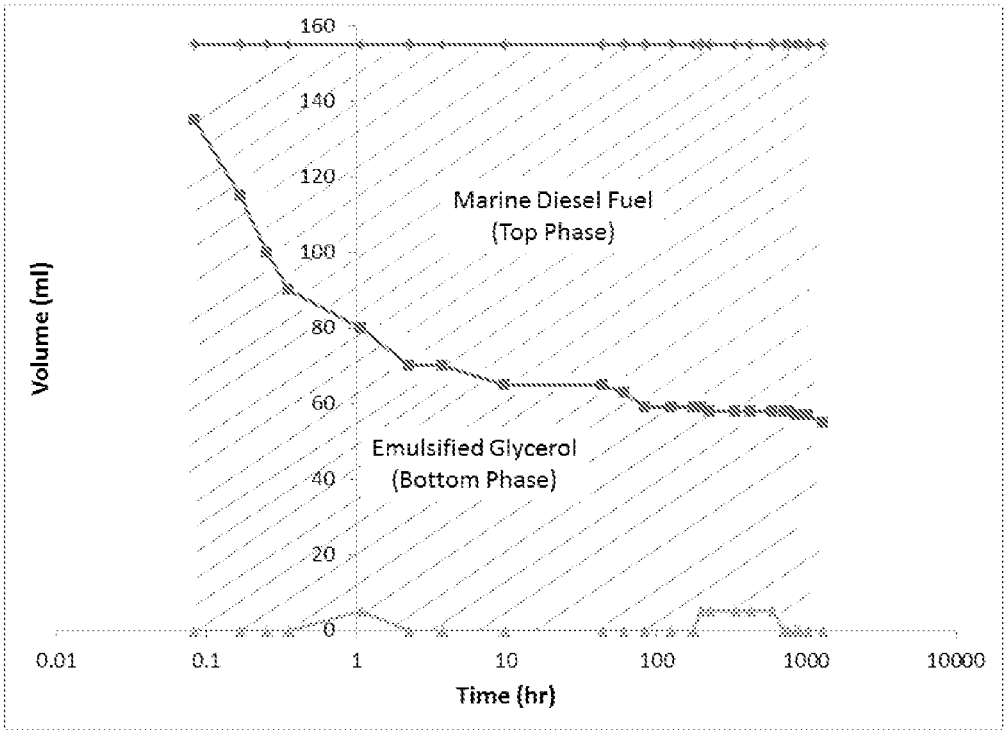
FIG. 3 shows an emulsion stability plot showing a gradual glycerol droplet sedimentation followed by long term emulsion stability of the flocculated droplets.

Demonstration of Long-Term Chemical Stability of MDO, Glycerol and Surfactant System 97.5 mL of ULSD and 52.5 mL of reagent grade glycerol is placed in a 300 mL wide mouth Pyrex bottle. Surfactants consisting of Span 80 (6.6 g) and Span 85 (0.9 g) were splash blended with the MDO and glycerol. The sample was heated in a water bath to 50° C. and emulsified using a 20 kHz ultrasonic processor with an intensity of 50 Watts for 15 seconds with a resulting energy input into the fuel mixture of 813 J. The resulting mixture was a homogeneous amber color with a viscosity of 7.5 cst. at 50° C. The sample was allowed to slowly cool to room temperature and monitored for creaming/sedimentation and chemical stability over a period of 2 months. As shown in FIG. 3, which details the time evolution of the sample for emulsion stability, the sample underwent complete sedimentation of the glycerol droplets after 6 days under ambient conditions. The emulsion character of the droplets is retained as apparent by the amber color of the glycerol fraction due to the presence of surfactant and MDO between the close packed glycerol droplets. The emulsion was allowed to remain in this configuration at room temperature for a further 2 months, in which the emulsion remained chemically stable. This was verified by agitating the sample by gently rolling the sample bottle, which reconstituted the emulsion to a homogeneous sample. Long term stability is demonstrated in FIG. 5.

Figure 5:
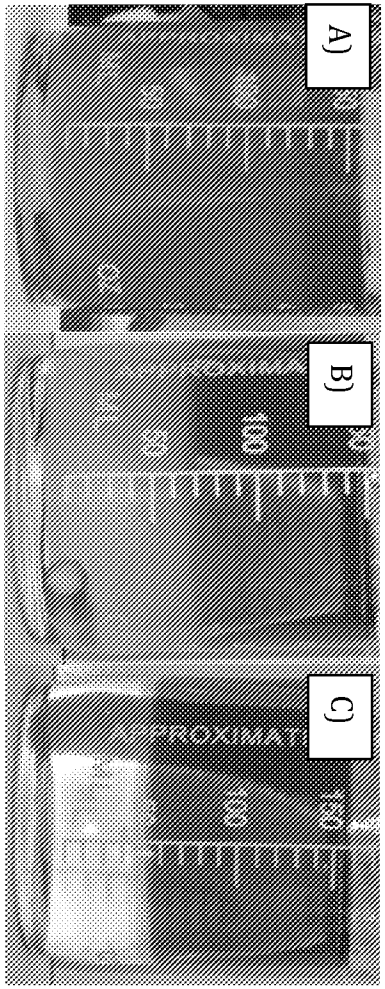
FIG. 5 shows the relationship between (A) a homogeneous fuel mixture, (B) a chemically stable, but non-homogenous fuel mixture and (C) a fuel mixture that is neither chemically stable nor homogenous as were made according to Example 4.

FIG. 5 also shows the relationship between (A) a homogeneous fuel mixture, (B) a chemically stable, but non-homogenous fuel mixture and (C) a fuel mixture that is neither chemically stable or homogenous as were made according to Example 4. In case (B), the denser glycerol droplets sediment out of the fuel oil phase, but glycerol droplets remain chemically stable and retain droplet size and surfactant interface coverage. In case (C), the glycerol droplets were not chemically stable and resulted in emulsion breaking as depicted by the free glycerol layer at the bottom of the bottle.

EXAMPLE 5

Figure 4:
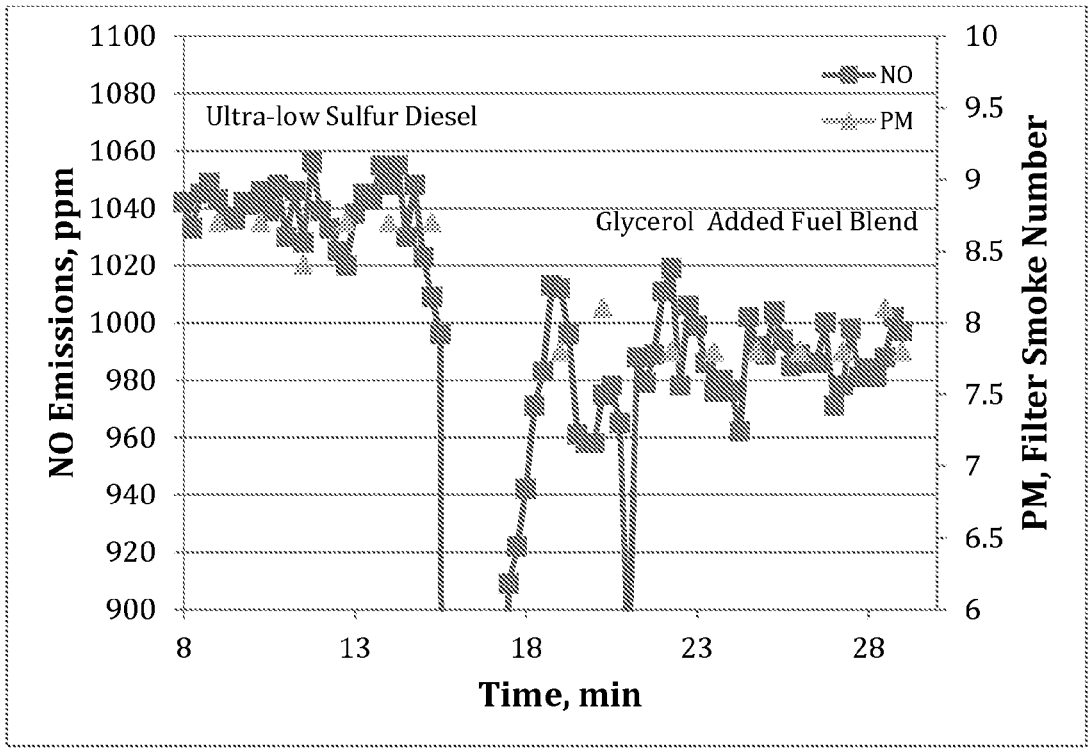
FIG. 4 shows the emissions evolution from a single cylinder diesel engine operating at 2,000 RPM and a nominal fuel rate of 12.2 kW for commercial ultra-low sulfur diesel compared to a fuel mixture consisting of 266.6 mL ultra-low sulfur diesel, 20 mL glycerol, 6.6 mL 2,5-bis(ethoxymethyl) furan, and 6.6 mL distilled water and 3 mL of technical grade mono-/di- and tri-glycerides surfactant.

Combustion and Emissions Characterization of a Glycerol Added Fuel Blend 30 mL of reagent grade glycerol is splash blended with 10 mL water and 10 mL 2,5-bis(ethoxymethyl)furan in a 300 mL wide-mouth Pyrex beaker. 100 mL of ultra-low sulfur diesel is followed with dissolved with technical grade mixed mono-/di- and triglycerides. The mixture is placed in a water bath and brought to 50° C. The heated mixture is ultrasonically processed using a 20 kHz ultrasonic processor with a ½" horn operating with an intensity of 55 Watts for 40 seconds. The resulting mixture obtains a homogeneous cloudy white color. The blended fuel was subsequently diluted by splash blending an additional 200 mL ultra-low sulfur diesel to achieve 6.6% glycerol in fuel (vol/vol) and operated in an air-cooled, high speed, single-cylinder diesel engine with a bore of 80 mm, stroke of 69 mm, displacement of 0.347 liter and a compression ratio of 22:1. The engine was maintained at a speed of 2,000 revolutions per minutes using a water-brake dynamometer with a nominal fueling rate of 12.2 kW. NO, $NO_2$, $CO_2$, $O_2$, CO where monitored using electrochemical sensors and PM emissions were monitored using traditional filter paper techniques. The resulting emissions for NO are reduced by 6.2% (ppm/ppm) and particular matter is reduced by 10.3% (FSN/FSN) as shown in FIG. 4.

What is claimed is:

1. A fuel mixture comprising:

(a) an oil in an amount from about 50% to about 99% (vol/vol) of the fuel mixture;

(b) a plurality of droplets evenly dispersed in the oil, wherein the droplets have sizes of from about 100 nm to about 10μm; the droplets comprise glycerol, a combustion improver, and water; the combustion improver is an ether; the combustion improver is present in an amount less than about 10% (wt/wt) of the glycerol; and water is present in an amount less than about 20% (wt/wt) of the glycerol; and (c) a surfactant in an amount from about 0.1% to about 5% (wt/wt) of the fuel mixture, wherein the mixture remains homogeneous or chemically stable at room temperature for at least 24 hours.

2. The fuel mixture of claim 1, wherein the mixture comprises about 65% oil (vol/vol).

3. The fuel mixture of claim 1, wherein the mixture comprises from about 1% to about 50% glycerol (vol/vol).

4. The fuel mixture of claim 1, wherein the mixture comprises about 35% glycerol (vol/vol).

5. The fuel mixture of claim 1, wherein the surfactant is selected from the group consisting of a polyethylene glycol, a polyoxyethylene, a glyceride, a polyglycerol, a sorbitan glycoside, an ester, and an acid, and mixtures thereof.

6. The fuel mixture of claim 1, further comprising a viscosity enhancer, wherein the viscosity enhancer is selected from the group consisting of a resin, a resin acid, a polyurea, a nitroester, a polyolefin, and an elastomer, and mixtures thereof.

7. The fuel mixture of claim 1, wherein the mixture contains less than about 0.1% by mass elemental sulfur.

8. The fuel mixture of claim 1, wherein the oil is a fuel oil.

9. A process for producing the fuel mixture of claim 1, comprising the steps of:

providing (i) the oil, (ii) crude glycerol, and (iii) the surfactant;

heating the crude glycerol to a temperature from about 40 ° C. to about 70 ° C.; and mixing the oil and the crude glycerol with a sonic blender at from about 40 Watts to about 75 Watts for from about 15 to about 40 seconds at about 20 kHz, with a total energy input of about 2,000 J per 150 mL, wherein the crude glycerol comprises the combustion improver and water.

10. A fuel mixture comprising:

(a) an oil selected from the group consisting of marine gas oil, marine diesel oil, intermediate fuel oil, low sulfur diesel, ultra-low sulfur diesel and residual fuel oil;

(b) a plurality of droplets evenly dispersed in the oil, wherein the droplets have sizes of from about 100 nm to about 10 μm; the droplets comprise glycerol, a combustion improver, and water; and the combustion improver is an ether; and (c) a surfactant in an amount from about 0.1% to about 5% (wt/wt) of the fuel mixture, wherein the mixture remains homogeneous or chemically stable at room temperature for at least 24 hours.

11. The fuel mixture of claim 10, wherein the oil is selected from the group consisting of marine gas oil, low sulfur diesel, and ultra-low sulfur diesel.

12. The fuel mixture of claim 10, wherein the droplets further comprise methanol or a salt.

13. The fuel mixture of claim 10, wherein the surfactant is selected from the group consisting of a polyethylene glycol, a polyoxyethylene, a glyceride, a polyglycerol, a sorbitan glycoside, an ester, and an acid, and mixtures thereof.

14. The fuel mixture of claim 10, further comprising a viscosity enhancer, wherein the viscosity enhancer is selected from the group consisting of a resin, a resin acid, a polyurea, a nitroester, a polyolefin, and an elastomer, and mixtures thereof.

15. The fuel mixture of claim 10, wherein the mixture contains less than about 0.1% by mass elemental sulfur.

16. A process for producing the fuel mixture of claim 10, comprising the steps of:

providing (i) the oil, (ii) crude glycerol, and (iii) the surfactant;

heating the crude glycerol to a temperature from about 40 ° C. to about 70 ° C.; and mixing the oil and the crude glycerol with a sonic blender at from about 40 Watts to about 75 Watts for from about 15 to about 40 seconds at about 20 kHz, with a total energy input of about 2,000 J per 150 mL, wherein the crude glycerol comprises the combustion improver and water.

17. A fuel mixture consisting essentially of:

(a) an oil in an amount from about 50% to about 99% (vol/vol) of the fuel mixture, wherein the oil is selected from the group consisting of marine gas oil, marine diesel oil, intermediate fuel oil, low sulfur diesel, ultra-low sulfur diesel and residual fuel oil;

(b) a plurality of droplets evenly dispersed in the oil, wherein the droplets have sizes of from about 100 nm to about 10 μm; the droplets consist essentially of glycerol, a combustion improver, and water; and the combustion improver is an ether; and (c) a mixture of surfactants in an a cumulative amount from about 0.1% to about 5% (wt/wt) of the fuel mixture; and the mixture of surfactants consists essentially of a polyoxyethylene moiety and an ester moiety, wherein the mixture remains homogeneous or chemically stable at room temperature for at least 24 hours.

18. The fuel mixture of claim 1, wherein the surfactant is a mixture of surfactants; the mixture of surfactants is present in a cumulative amount from about 0.1% to about 5% (wt/wt) of the fuel mixture; and the mixture of surfactants comprises a polyoxyethylene moiety and an ester moiety.

19. The fuel mixture of claim 1, wherein the droplets have sizes of from about 1 μm to about 4 μm.

20. The fuel mixture of claim 1, wherein the mixture remains chemically stable at room temperature for at least 6 months.

21. The fuel mixture of claim 1, wherein the combustion improver is 2,5-bis(ethoxymethyl)furan.

22. The fuel mixture of claim 10, wherein the surfactant is a mixture of surfactants; the mixture of surfactants is present in a cumulative amount from about 0.1% to about 5% (wt/wt)

of the fuel mixture; and the mixture of surfactants comprises a polyoxyethylene moiety and an ester moiety.

23. The fuel mixture of claim 10, wherein the droplets have sizes of from about 1 μm to about 4 μm.

24. The fuel mixture of claim 10, wherein the mixture remains chemically stable at room temperature for at least 6 months.

25. The fuel mixture of claim 10, wherein the combustion improver is 2,5-bis(ethoxymethyl)furan.

26. The fuel mixture of claim 17, wherein the droplets have sizes of from about 1 μm to about 4 μm.

27. The fuel mixture of claim 17, wherein the mixture remains chemically stable at room temperature for at least 6 months.

28. The fuel mixture of claim 17, wherein the combustion improver is 2,5-bis(ethoxymethyl)furan.

* * * * *